US009175915B2

(12) United States Patent
Harvey

(10) Patent No.: US 9,175,915 B2
(45) Date of Patent: Nov. 3, 2015

(54) APPARATUS AND METHODS FOR SAFE USE AND STORAGE OF FIREARMS AND WEAPONS

(71) Applicant: Thomas Danaher Harvey, Rockville, MD (US)

(72) Inventor: Thomas Danaher Harvey, Rockville, MD (US)

( * ) Notice: Subject to any disclaimer, the term of this patent is extended or adjusted under 35 U.S.C. 154(b) by 0 days.

(21) Appl. No.: 14/311,311

(22) Filed: Jun. 22, 2014

(65) Prior Publication Data

US 2015/0247692 A1 Sep. 3, 2015

(51) Int. Cl.
*F41A 17/00* (2006.01)

(52) U.S. Cl.
CPC ..... *F41A 17/00* (2013.01)

(58) Field of Classification Search
CPC ..... F41A 17/00; F41A 17/06; F41A 17/063; F41A 17/08; F41A 17/30; F41A 17/46
USPC ..... 42/70.11, 84, 70.01, 70.07, 70.06, 66
See application file for complete search history.

(56) References Cited

U.S. PATENT DOCUMENTS 5,062,232 A * 11/1991 Eppler ..... 42/70.11
5,415,542 A * 5/1995 Kesling ..... 433/6
5,459,957 A 10/1995 Winer
5,651,206 A * 7/1997 Matarazzo ..... 42/70.08
5,924,232 A 7/1999 Rhoden
6,223,461 B1 * 5/2001 Mardirossian ..... 42/70.11
6,253,480 B1 * 7/2001 Florez ..... 42/70.11
6,320,975 B1 * 11/2001 Vieweg ..... 382/124
7,849,624 B2 12/2010 Holt
8,166,693 B2 5/2012 Hughes
8,418,391 B2 4/2013 Kemmerer
2013/0125441 A1 5/2013 Westland
2014/0182179 A1 * 7/2014 McHale ..... 42/70.06
2014/0259841 A1 * 9/2014 Carlson ..... 42/1.01
2014/0366419 A1 * 12/2014 Allan ..... 42/70.06
2014/0366421 A1 * 12/2014 Arif et al. ..... 42/70.11
2014/0378088 A1 * 12/2014 Goel et al. ..... 455/404.2
2015/0040453 A1 * 2/2015 Ballard et al. ..... 42/70.11
2015/0184962 A1 * 7/2015 Burdine ..... 42/70.11

* cited by examiner

*Primary Examiner* — Joshua Freeman

(57) ABSTRACT

A lock for a firearm or weapon is disclosed that enables the weapon when control is established by a user while the weapon is in a storage location or holding device. The weapon remains operable as long as the user continuously remains in control but is disabled until returned to the storage location or device if the user relinquishes control. Storage and user zones are defined by weapon location or input devices such as a grip safety. Mechanical devices or signals transfer the zone determinations to a logic device. When the logic device, which may be mechanical, electronic or implemented in other way, determines that the weapon is considered to be both in the storage zone and the user zone and it causes transition to an operable state. The logic device causes transition to an inoperable state if the weapon is determined not to be in either zone.

12 Claims, 10 Drawing Sheets

APPARATUS AND METHODS FOR SAFE USE AND STORAGE OF FIREARMS AND WEAPONS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The field of the present invention is firearm safety devices.

Many people wish to have firearms readily available for self defense. When there is no perceived threat, a hand gun may be stored in a specific place from which it may be taken to be used after a threat appears. The storage places vary greatly. Some may be rooms deemed secure, others may be locked storage devices such as quick opening safes and still others may be as close to the user as a holster strapped to the user's body. Such a gun is typically desired to enter a state of increased readiness when it is taken from the storage place into the direct control of the user. A safety system that arms a gun when the gun is removed from the storage place is desirable.

But, at a later time the user may put the gun down from his hand or otherwise relinquish direct control of the gun and for various reasons not return the gun to the safe place of storage. Or the gun may be taken from the user and used by another person as an additional threat. A safety system that disarms a gun when the direct control of the gun's user is released is also desirable.

A typical situation where these two goals interact occurs when a person awakens to a unrecognized sound at night and takes a gun from a quick opening storage safe. After searching for the source the person lays the gun down and returns to bed. If there are children in the house, a child may find the gun and a tragic accident may result. Such situations are commonly reported in the media. In another possibility, the homeowner may be surprised by an intruder, the gun knocked out of the homeowner's hand and a struggle may ensue. It is desirable that the intruder not be able to use the gun against the homeowner.

Smart guns which use various means to specifically identify the user have met with substantial resistance in the market place. Many people fear that such guns will be mandated by governmental authorities if they become available or commonplace or that governmental authorities will take control of the guns with some overriding technical means. Many gun dealers have refused to sell smart guns.

There is a need for a system of protection from use of a gun by an unauthorized person by means that are broader than identification of the user.

Operative control of the ability of a firearm to discharge by means of a wireless link is well known to persons skilled in the design of smart guns. One system for implementing such control is described in detail in U.S. Pat. No. 5,924,232 A to Rhoden, which is hereby incorporated by reference and herein referred to as Rhoden.

This and all other referenced patents and applications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

Operative control of the ability of a firearm to discharge on the basis of the location of the weapon is well known to persons skilled in the design of smart guns. U.S. Pat. No. 8,166,693 B2 to Hughes herein referred to as Hughes describes one such system and is herein incorporated in its entirety by reference. Hughes differs from the present invention in several ways. In particular, Hughes contemplates the control of a weapon by means of a logical device with an external data input combined with the presence of the weapon in a defined location called a zone. Hughes does not contemplate the control of a weapon by the presence of the weapon simultaneously in two separately designated zones.

BRIEF SUMMARY OF THE INVENTION

The various embodiments disclosed herein contemplate methods and systems for preventing the unwanted discharge of a firearm. The firearm is held in a storage area or device in such a way that when it gripped or otherwise taken into the control of a user and then removed from the storage area or device, it is in an armed state. If the grip or other control of the user is released then the firearm enters a disarmed state. The armed state is prevented from being reestablished until the firearm is returned to the storage area or device.

The conditions for arming or disarming the firearm may be modified in specific situations by other inputs than being in the control of the user or being located in the storage area or device. Examples of such modifications include establishing a time delay before disarming the firearm and having specific conditions other than being in the storage device or area which allow the firearm to be rearmed.

A variety of storage devices are contemplated. Many of them are of the nature of a nest, socket or receiver that physically holds the firearm and are herein referred to as a firearm receiver. The device could be further located in a locked safe or box or in a holster designed to hold firearms. The device must be connected to the firearm in a way that allows the apparatus mounted in or on the firearm to accept control of the user and become armed only when the device enables such action. The connection may be mechanical with a physical operating element that interacts with the apparatus mounted in or on the firearm or the connection may be other than mechanical. It may consist of signals that indicate that the gun is in contemplated storage. The storage device may be a room or other physical area defined by the use of signals delivered to the device controlling the gun.

A variety of ways are contemplated for the user of the firearm to maintain control of the firearm. The user may grip the gun in a way that depresses a grip safety which is connected to control discharge of the firearm. This grip safety may itself partially control the firing mechanism of the gun and may be inhibited by the additional apparatus here contemplated, or an apparatus to inhibit the firing mechanism may use the actuation of a grip safety as one factor in making the inhibition.

There is contemplated an apparatus for preventing the discharge of a firearm containing a firing mechanism and a grip safety that allows operation of the firearm when the grip safety is in the operative state. The safety can be put in the operative state by the user when the firearm is located in a firearm receiver. The grip safety can be put in the non-operative state by the user when the firearm is not in the firearm receiver and the grip safety cannot be put into the operative state when the firearm is not inserted into the firearm receiver.

The method of putting the grip safety into the respective states may be by grasping and ungrasping the firearm. The operative connection between the firearm receiver and the grip safety may be by mechanical device or by electrical signals or by other means. The firearm receiver may be carried by the user of the firearm.

There is contemplated an apparatus for preventing the discharge of a firearm containing a firing mechanism with an actuator having an actuated and a not actuated state. The operation of the firing mechanism is allowed if the actuator is in the actuated state and prohibited if the actuator is in the not actuated state. The apparatus also includes a firearm receiver, a signal receiver and a logic device. The logic device controls the actuator based on the presence of the firearm in the firearm receiver and the receipt of a signal by the signal receiver. The logic device puts the actuator into the actuated state on receipt of a predefined signal condition if the firearm is in the firearm receiver. The logic device puts the actuator into the not activated state on receipt of a different predefined signal condition. A signal condition may indicate that a user in control of the firearm. The firearm receiver may be a holster attached to a user of the firearm.

There is also contemplated a weapon system with a state machine having an operational and a non-operational state. There are two zone testers each with a zone. A zone is a set of potential locations or conditions concerning the weapon. The presence of the weapon in a zone is determined by a zone tester. At least one function of the weapon is not operational when the state machine is in the non-operational state. The state machine is placed in the operational state when the two zone detectors simultaneously determine that the weapon is in their respective zones. The state machine is placed in the non-operational state when the second zone tester determines the weapon is not within the second zone. If the weapon enters the second zone while in the first zone as determined by the respective zone testers, the state machine may or may not enter the operational state. There is also contemplated a method of controlling the state machine by modifying the zones or the markers defining one or both of the zones.

BRIEF DESCRIPTION OF THE SEVERAL VIEWS OF THE DRAWINGS

The features and advantages of the various embodiments disclosed herein will be better understood with respect to the following drawings in which.

DETAILED DESCRIPTION OF THE INVENTION

Figure 1:
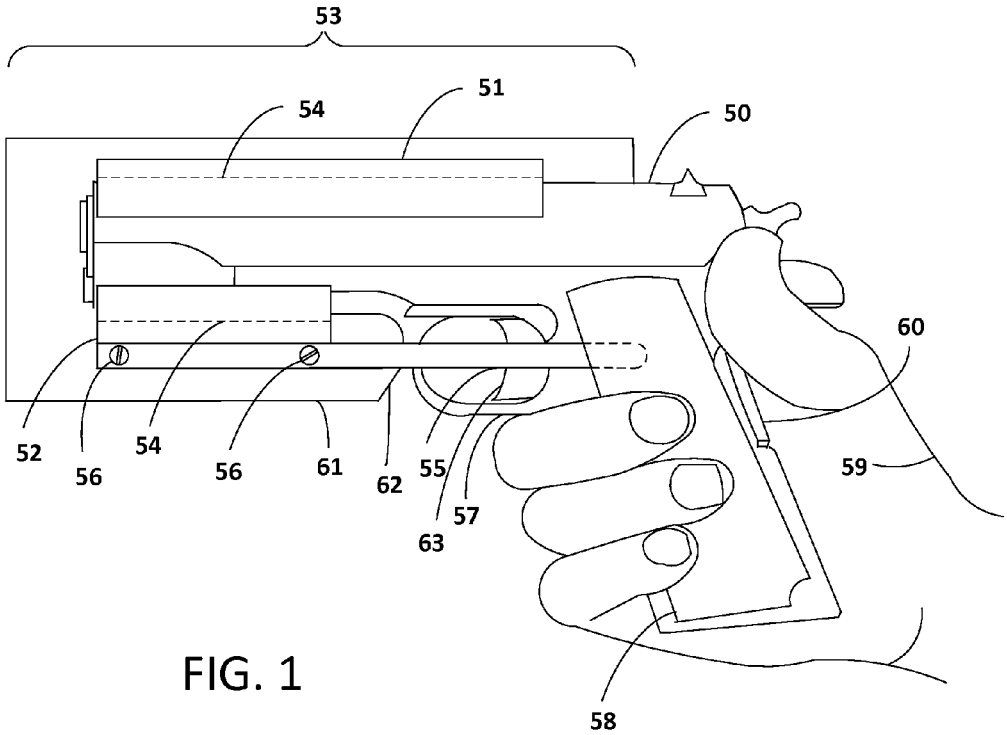
FIG. 1 is a left side view of a handgun inserted into a firearm receiver and griped by a user prior to being removed from the firearm receiver. The operative element of the firearm receiver is shown entering the space between the frame of the handgun and the handgun grip cover. The thumb and palm of the user are depressing the grip safety to a position where the firearm may be discharged.

The terms weapon, function of a weapon, zone, and zone tester are discussed and defined in detail in Hughes. The definitions of these terms herein and as used in the description and claims herein are summaries of the detailed definitions in the referenced patent and are intended to encompass the full breadth of the definitions in Hughes.

A weapon includes but is not limited to a firearm. It includes a product as defined in Hughes and any device which carries a risk of creating personal, property or financial damage. It includes conventional weaponry apparatus (e.g., a mechanism or circuit) for implementing all conventional operations of a lethal or nonlethal firearm, mine, projectile, area denial system, and/or electronic control device. For example, for an implementation of a weapon as an electronic control device, a weapon may include magazine, cartridge, or projectile circuitry of the conventional type that produces a current through skeletal muscles of a human or animal target to halt locomotion by the target. A weapon as herein defined includes electronic or mechanical devices that give access to locations, command functions of other systems, or execute transactions by means of signals.

A function of a weapon includes but is not limited to discharge or operation of the weapon. It includes enablement of particular modes (e. g. a local stun function, limited range function, use of particular cartridges or establishment or release of other limitations). It includes the transmission of signals that control apparatus not a part of the weapon or the initiation or control of transactions processed by information processing apparatus initiated or modified by means of transmissions of signals from the weapon. When a weapon or a device associated with a weapon causes an action associated with a function of the weapon to occur the function is said to be executed.

A zone is a region of space defined by one or more markers. A zone may be defined by a physical distance, such as a range of communication by any signaling technology. For example, a product may be in a zone when the product is proximate to a marker within the physical distance. In one implementation, the marker defines the zone by the physical location of the marker. The zone may include an area or volume (herein called a region) within which communication is within range. In one implementation, the marker defines the zone by its central location within the region. Markers may be unique or duplicated. For example, numerous identical markers may be used to include in a zone overlapping or distinct regions of the same type.

A zone tester determines whether a condition related to a zone is satisfied (e.g., the zone tester is in a zone). When a zone tester determines that the conditions related to a zone are satisfied, the weapon is said to be in that zone. A weapon may be in one zone, no zones or more that one zone at a time. When a zone tester is mechanically coupled to a weapon, the location of the zone tester may imply the location of the weapon. Because a zone may be defined by several different types of signals, a zone tester includes any suitable mechanical and/or electrical components to accomplish determining whether the condition as to a particular zone is satisfied. As a first example, when a zone is defined by proximity to a simple marker such as a passive object (e.g., a reflector, RFID device, magnetic fob, smartcard, mechanical key), a zone tester may include a mechanical receiver for the object or for retaining the object and an actuating switch, a conventional proximity sensor, and/or suitable output circuitry to electrically control a switch. As another example, when a zone is defined by radio signals and/or messages communicated with one or more markers, the term zone tester includes a signal receiver which receives signals indicating the presence of a weapon in a zone and may further include logic circuitry for processing such signals and/or messages.

A weapon may be described herein as moving into or out of a zone. That movement is defined as being a relative movement of the weapon and markers or zone testers. Moving into a zone means to establish a condition where a zone tester determines the weapon is in the zone, and moving out of a zone means establishing a condition where a zone tester determines the weapon is not in the zone.

A category of embodiments place a firearm in an operational condition when the firearm is griped while it is safely stored in a storage device and allows the firearm to remain operational as long as it is continuously gripped by the users hand. If the grip is released the firearm remains non-operational until it is returned to the storage device regardless of being subsequently gripped by the user or an unauthorized person.

Simultaneous determination of presence in the zones of two zone testers includes such determination within a time sufficiently long to allow operation of the zone testers, comparison of their results and implementation in a logic module of the result of this comparison. If a signal from a zone tester or determination by a zone tester is intended to indicate the presence of a weapon in a zone is continuing until another signal or determination is transmitted by or received from the zone tester then that continuing presence prior to the second signal or determination by the zone tester is used in determining simultaneous presence in two zones. Any signal content or condition including the presence or absence of a signal may be predefined to indicate presence or lack of presence of the weapon in a zone.

Throughout this disclosure and in the claims of this disclosure the term firearm receiver refers to a device with a space to receive a firearm and not to a part of the firearm. A firearm receiver may accept a handgun, a firearm or a weapon.

A firing mechanism of a firearm is the parts of the firearm that function to cause the discharge of the firearm when the user of the firearm pulls the trigger of the firearm or takes other action intended to cause such discharge. If action is taken autonomously by mechanisms not directly commanded by the user to cause discharge, these mechanisms are included. The firing mechanism may be mechanical, include electrical parts or include parts that function by other means.

The first embodiment described in this disclosure is depicted in FIG. 1 through FIG. 4. It envisions a model 1911A1 semi-automatic pistol 50. This embodiment may be easily adapted to other models of handguns which incorporate a grip safety mechanism. A grip safety is a device which prevents the discharge of a handgun unless the grip safety, which is designed to be depressed by the user when the handgun is firmly grasped by the user by the handle in the manner that the designer of the handgun envisions, is depressed. In other embodiments a grip safety may be another device which detects the presence of a user and controls the operation of the handgun, firearm or weapon. A grip safety may be said to have two states and to be placed in one of the states by the grip of the user.

A handgun is a type of firearm which is designed to be griped in the hand of a user. A firearm is a weapon which launches one or more projectiles by gas pressure or other energy sources. Launching a projectile constitutes discharge of the firearm.

Disabling the operation of a firing mechanism is one way of preventing the discharge of the firearm.

The user of a handgun, firearm or weapon is a person who has control of the operation of the handgun, firearm or weapon or may command the discharge of the handgun, firearm, or weapon or the execution of a function of the handgun, firearm or weapon.

Referring to FIG. 1, the handgun 50 is inserted between the upper rail 51 and the lower rail 52 of the firearm receiver 53. Both upper rail 51 and lower rail 52 have grooves 54 to allow insertion of the handgun 50. The rails also serve to hold the handgun in the proper position. The rails are made sufficiently snug to retain the handgun against the tension of the spring element 70, shown in FIG. 2, and incidental forces. Variations of this embodiment may add further elements to aid in retention of the gun in the receiver. An operating element 55 is mounted to the lower rail 52 and is retained by two screws 56. When the handgun 50 is fully inserted into the firearm receiver 53, the operating element 55 projects into the space between the frame 57 of the handgun and the grip cover 58. A hand 59 belonging to the handgun user grips the handgun and depresses the grip safety 60. The parts of the firearm receiver 53 are supported by a frame 61 which is has a relief 62 to allow space for the trigger finger of the hand. In other embodiments a handgun, firearm or weapon is defined as being inserted into the firearm receiver if the logical device in the handgun, firearm or weapon is receiving the input associated with that condition.

Figure 2:
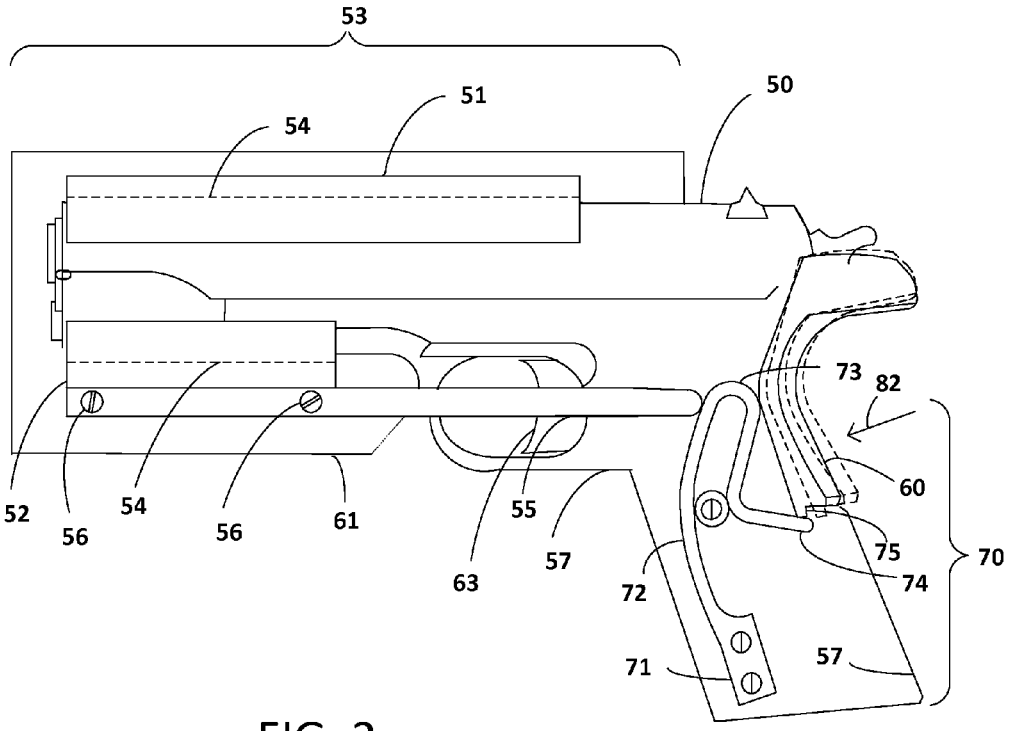
FIG. 2 is a left side view of a handgun inserted into a firearm receiver. The grip cover and the hand of the user are not shown in this drawing for clarity. The operation of the grip safety is shown.

Referring to FIG. 2, the user's hand 59 and the grip cover 58 are omitted to show the parts located between the grip cover 58 and the handgun frame 57. A spring element 70 is shown in its bent configuration in FIG. 2. and in its relaxed configuration in FIG. 3. The spring element has a mounting tab 71, a main leg 72, an upper leg 73 and a stopper leg 74. The operating element 55 deforms the upper leg 73 of the spring. The spring is made of an elastic material such as spring steel or an engineering plastic and is dimensioned to provide an appropriate resistance and strength. The stopper leg 74 may be wider and thicker than the main leg 72 and upper leg 73. A cylindrical pin 81 is attached to the frame of the firearm to support the stopper leg 74 against longitudinal forces from the grip safety 60.

FIG. 2 Shows the state of the handgun grip safety when the handgun 50 is inserted into the receiver 53 and grasped by the user's hand. In FIG. 2, the operating element 55 flexes the spring element 70 moving the upper leg 73 to the right. The angle of the upper leg 73 and the stopper leg 74 is moved clockwise about the point of contact of the main leg 72 of the string element 70 and the distal end of the stopper leg 80 is moved downward. The stopper leg 74 is taken out of the path of the lower tip 75 of the grip safety which can now move to the left responding to the pressure of the firearm users thumb and palm. The grip safety is depressed by moving it in the inward direction shown by the arrow 82 and the handgun is enabled to discharge when the user pulls the trigger 63.

Figure 3:
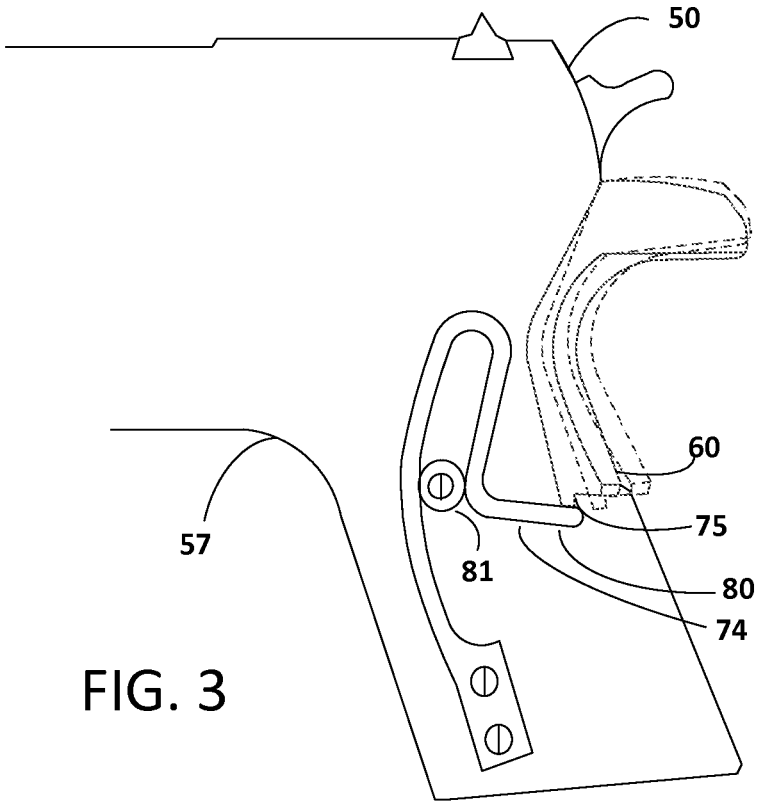
FIG. 3 is a left side view of a handgun that has been removed from the firearm receiver. The grip cover and the hand of the user are not shown in this drawing for clarity. The grip safety is in the state where it would be if depressed before the handgun was removed from the firearm receiver and held depressed by the user continuously since that removal.

Referring to FIG. 3, the user's hand 59 and the grip cover 58 are omitted to show the parts located between the grip cover 58 and the handgun frame 57. The handgun 50 has been removed from the receiver 53 and the user's hand 59 is providing depressive force on the grip safety. The grip safety 60 is shown in the operative and not safe position in solid lines in response to this force. The undepressed, inoperative and safe position is shown is dashed lines. Operationally, here the figure illustrates the grip safety remaining in the depressed position and the handgun remains enabled to discharge. The lower tip of the grip safety 75 prevents the distal end 80 of the stopper leg 74 from moving into the path of the grip safety 60 as long as the grip safety remains depressed. The cylindrical pin 81 prevents the stopper leg 74 from moving to the left under the pressure of attempts to depress the grip safety until the handgun 50 is returned to the receiver 53.

Figure 4:
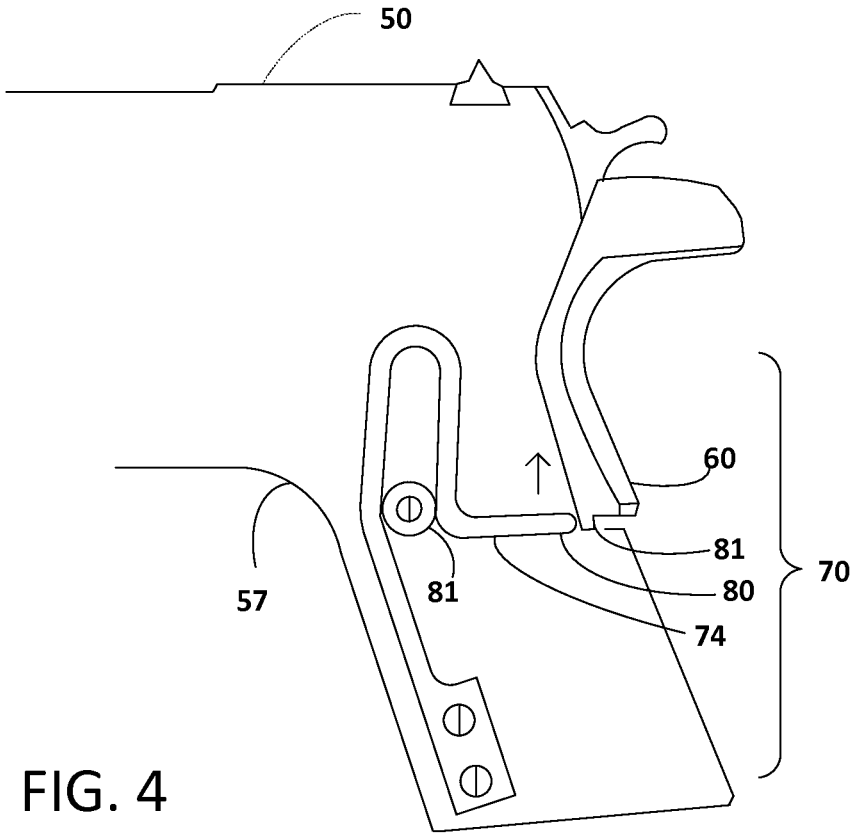
FIG. 4 is a left side view of a handgun that has been removed from the firearm receiver. The grip cover and the hand of the user are not shown in this drawing for clarity. The grip safety is in the state in which it would be if it were not depressed before the handgun was removed from the firearm receiver or if it were not held depressed by the user continuously since that removal.

Referring to FIG. 4, the user's hand 59 and the grip cover 58 are omitted to show the parts located between the grip cover 58 and the handgun frame 57. The handgun 50 has been removed from the receiver 53 and the user's hand 59 is not providing depressive force on the grip safety. The grip safety is shown is the undepressed position and the handgun is prevented from discharging. The distal tip 80 of the stopper leg 74 has moved to the upper position and prevents the grip safety from being depressed. This renders the handgun safe and prevented from discharge until it is returned to the receiver. The spring element 71 is in its relaxed state. The stopper leg 74 of the spring element is prevented from being moved to the left by contact with the cylindrical pin 81.

Thus the handgun 50 may be discharged by pulling the trigger 63 only if the grip safety 60 is depressed by the user's hand when the handgun is removed from the handgun receiver 53. If the grip safety 60 is released after the handgun is so removed the handgun may not be discharged and the grip safety may not be depressed until the handgun is returned to the handgun receiver 53.

The embodiment depicted in FIG. 1 through FIG. 4 may be modified in numerous ways. The particular embodiment illustrated is provided with large and easily visualized components for clarity. In other embodiments the parts may be reduced in size or modified in order to meet aesthetic goals. The parts may be adapted to allow existing handgun designs to be used with little modification other than substitution of a small number of simple parts.

An additional described embodiment is contemplated wherein the operative connection from the firearm user to the firearm is implemented as a wireless link. In other embodiments the operative connection from the firearm receiver to the firearm may be implemented by a wireless link or by other signals. Details of this embodiment are shown in FIG. 5 through FIG. 8. The embodiment depicted allows the user of the firearm to wear a transmitter in a manner similar to the way that watches are commonly worn. The signal from the transmitter is received by a signal receiver associated with the firearm and becomes one of the determinants used to determine the ability of the firearm to discharge. Other kinds of signals or signal transmitters are used in other embodiments to signal that the firearm is still under the control of the user and that continued ability to discharge is to be accomplished. These could be wired, wireless, sonic, optical or of other natures. A transmitter of signals is any device that emits or causes to be emitted a signal. A predefined signal condition is a condition established by the receipt of a signal or a sequence of signals that is designed to cause a certain state or change of state by itself or in combination with other determinants in a device connected to the signal receiver. A firearm is under control of a user when a person or some set of persons in a designated group of persons has exclusive ability to command the discharge of the firearm.

This embodiment also depicts a logic device to control the operation of the firing mechanism through an actuator. A logic device may be electrical, electronic or mechanical in operation and may be implemented by a microcontroller, microprocessor, electronic logic circuits, mechanical interacting elements or other devices to implement the conditions of operability and inoperability envisioned. The logic device determines the state of operability or inoperability based on the receipt of a suitable signal. The logic device may also use additional signals or conditions in making the determination. The logic device is connected to an actuator in order to control the operability of the firing mechanism. The actuator may be electromechanical, mechanical, piezoelectric or implemented in another way. The function of the actuator is to prevent or allow the operation of the firing mechanism in accordance with the determination made by the logic device.

An actuator is in an actuated state when the actuator is in a condition which allows operation of the associated firearm, firing mechanism or weapon. The actuator may accept signals or other inputs from a logic device that either determine the state of the actuator or change the state of an actuator in combination with a memory function implemented in the actuator.

Figure 5:
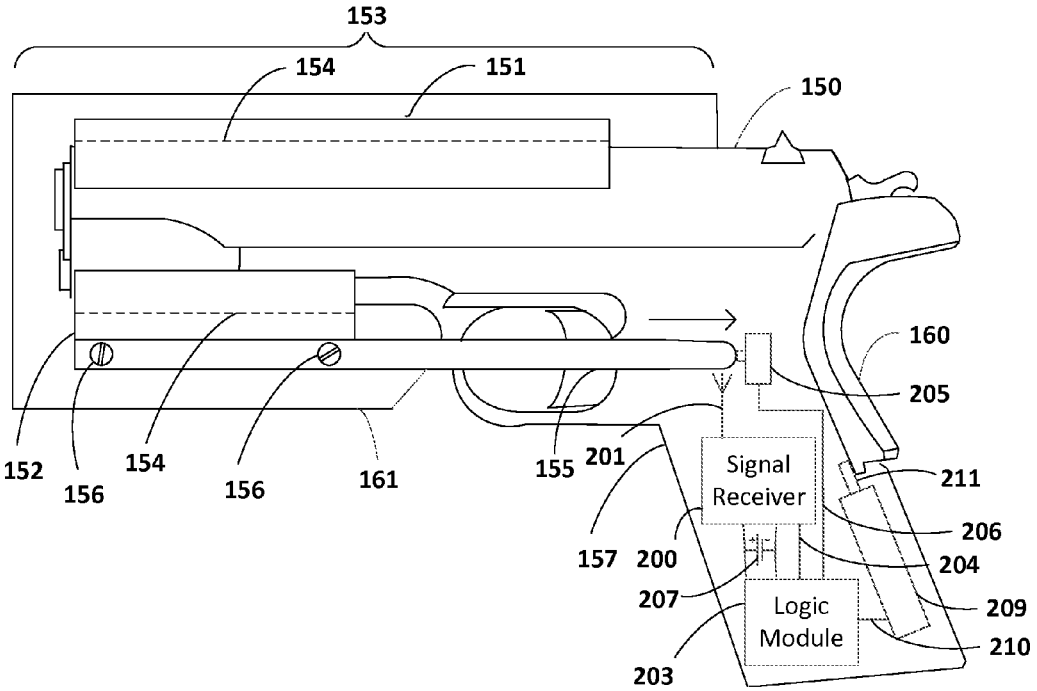
FIG. 5 is a left side view of a handgun with a signal receiver, a logic module, and an actuator inserted into a firearm receiver. The operative element of the firearm receiver is shown entering the space between the frame of the handgun and the handgun grip cover and operating the switch. There is no signal being received. The actuator is preventing the discharge of the firearm.

Referring to FIG. 5, a handgun 150 is inserted between an upper rail 151 and a lower rail 152 of a firearm receiver 153. Both upper rail 151 and lower rail 152 have grooves 154 to allow insertion of the handgun 151. The rails also serve to hold the handgun in the proper position. The rails are made sufficiently snug to retain the handgun against incidental forces. The rails are mounted on a firearm receiver frame 161. Variations of this embodiment may add further elements to aid in retention of the gun in the receiver. An operating element 155 is mounted to the lower rail 152 and is retained by two screws 156. When the handgun 151 is fully inserted into the firearm receiver 153, the operating element 155 projects into the space between the frame 157 of the handgun and a grip cover 158. The operating element 155 closes switch 205 which is connected by connection 206 to logic module 203. The logic device, herein also called a logic module, may be a microcontroller, microprocessor, electronic circuitry or other device which implements the logical steps described herein and places the actuator into either the actuated or the unactuated state as required by the logical requirements described. The logic module 203 and the signal receiver 200 are powered by battery 207 or by another power source. The signal receiver accepts signals 221 by means of antenna 201. The signal receiver 200 connected by connection 204 to the logic module. In this figure the signal receiver is not detecting a signal. The logic module 203 is connected by connection 210 operatively to the actuator 209 and places the actuator 209 in the unactuated position. In the embodiment depicted in FIG. 5 the unactuated position is the position where the actuator pin 211 is extended. The grip safety 160 is prevented from being depressed by the handgun user by the actuator pin 211. The grip safety 160 prevents discharge of the handgun 150 when it is in the undepressed position.

Figure 6:
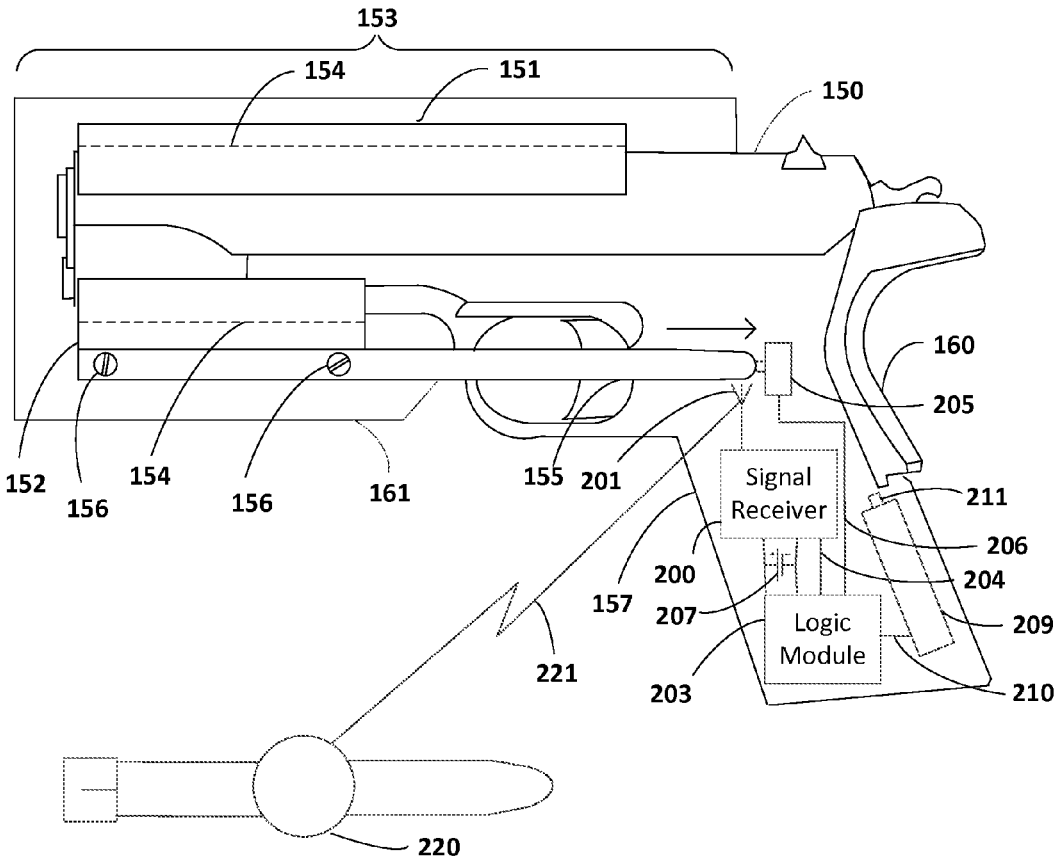
FIG. 6 is a left side view of a handgun inserted into a firearm receiver. The signal receiver is receiving a signal and actuator is allowing the discharge of the firearm.

FIG. 6 shows the components of FIG. 5 with the addition of a signal transmitter 220. The signal 221 emitted by the transmitter which may be wired, wireless, sonic, optical or other in nature is accepted by antenna 201, received by the signal receiver 200, and passed to the logic module 203 by connection 206. The actuator pin 211 is withdrawn. The grip safety 160 is allowed to be depressed by the handgun user by the withdrawal of actuator pin 211. The grip safety 160 allows discharge of the handgun 150 when it is in the depressed position. The embodiment depicted shows a handgun with a grip safety. Other embodiments may use a different actuator which allows or disallows discharge of the handgun by interaction with different parts of the firing mechanism of the handgun.

Figure 7:
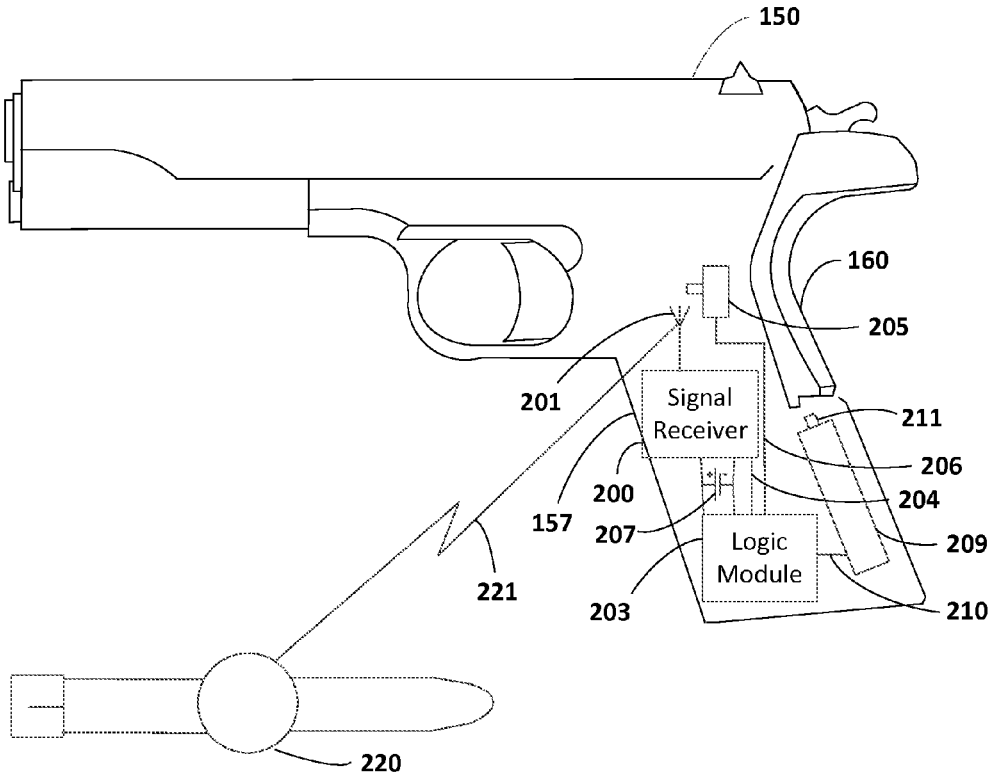
FIG. 7 is a left side view of a handgun that has been removed from the firearm receiver. The signal receiver is receiving a signal and actuator is allowing the discharge of the firearm.

FIG. 7 shows the components of FIG. 6 without the firearm receiver 153. The switch 205 is not closed and its condition is transferred to the logic module 203 by connection 206. The signal 221 emitted by the signal transmitter 220 is accepted by the antenna 201 and received by the signal receiver 200 and passed to the logic module 203 by connection 204. The logic module 203 continues to place the actuator 209 in the actuated position. Discharge of the handgun 150 remains possible.

Figure 8:
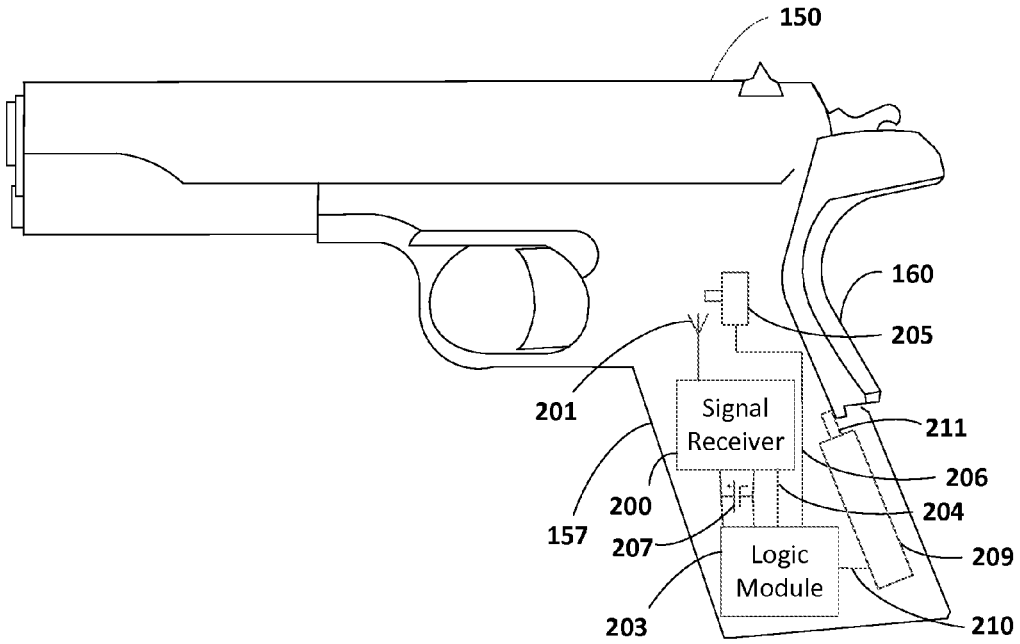
FIG. 8 is a left side view of a handgun that has been removed from the firearm receiver. There is no signal being received. The actuator is preventing the discharge of the firearm.

FIG. 8 shows the same components as FIG. 7 without the signal 221. The handgun 150 is not inserted into the handgun receiver 153. The logic module 203 places the actuator 209 in the unactuated position which extends the actuator pin 211 and prevents discharge of the handgun 150.

A third described embodiment is contemplated. This embodiment may be any weapon contemplated in Hughes and controlled by a state machine 307. A state machine is a logical device with at least two logical states. One and only one state is in effect at any given time. A state machine is said to enter a state when that state becomes in effect whether or not that state is already in effect. The state machine is connected to the weapon in a manner that one of the states 308 called operational allows operation of the weapon when the state machine is in this state and the other 309 of the two states called non-operational is prohibits operation of the weapon. The state machine uses two inputs from zone testers 300 and 302 to determine the state in effect at any given time.

Figure 9:
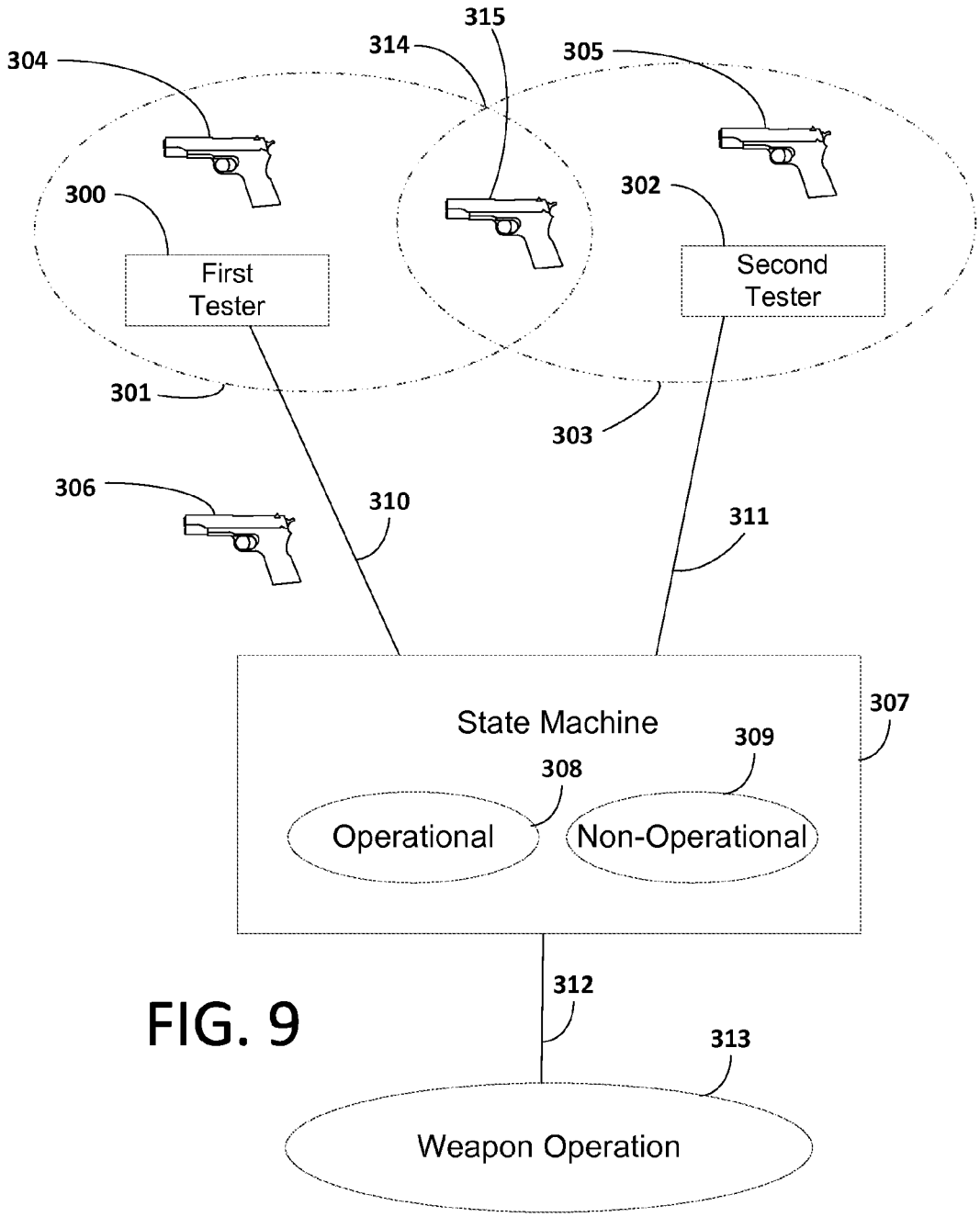
FIG. 9 is block diagram of the components of an embodiment containing two testers which determine the location of a weapon as inside or outside of corresponding zones and place the weapon in an operational or non-operational state based on the results.
Figure 10:
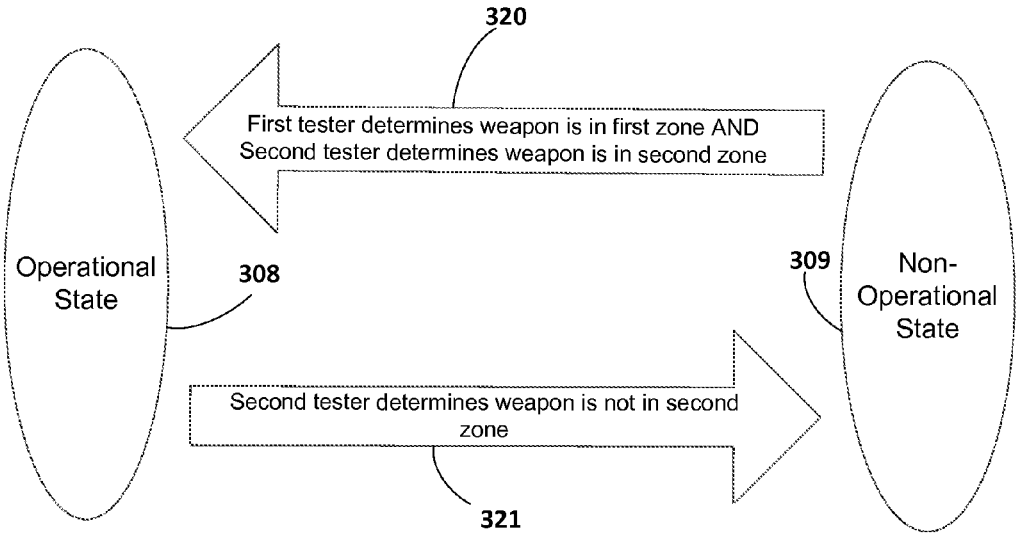
FIG. 10 is a logic diagram showing the conditions for placing a weapon in an operational or a non-operational state.

Referring to FIG. 9 and FIG. 10, weapon 304, as defined above and in Hughes, is located in a first zone 301 as determined by a first zone tester 300. This may indicate that the weapon is safely stored or some other condition. A zone tester may be referred to as being a storage zone tester or a user zone tester to illustrate one possible use of this embodiment. This is but one use of the concept of zones and other uses are contemplated. The weapon is not located in the second zone 303 and is determined not to be in the second zone by the second zone tester 302. The two conditions 320 which are required to be simultaneously met to transfer the state machine to the operational state 307 are not both present and the state machine does not transfer to the operational state. In one embodiment, the state machine, if not already in the not-operational state 308, will transfer to that state; and, in another embodiment, the state machine, if not already in the not-operational state, will not change state.

The weapon is contemplated as moving into the second zone 303 without leaving the first zone 301. This may indicate that the weapon is under the control of a user. The zones are considered to have an overlap 314. The weapon 315 is in two zones and is determined to be in the first zone 301 by the first zone tester 300 and to be in the second zone 303 by the second zone tester 302. The simultaneous determination satisfies both conditions of 320 and the state machine is placed in the operational state.

The weapon 305 is contemplated as moving out of the first zone 301 as determined by the first zone tester 300 without moving out of the second zone 303 as determined by the second zone tester 302. This may indicate that the user has retained control of the weapon and removed it from storage. The state machine is in the operational state 308 and remains in that state.

The weapon 306 is contemplated as moving out of the second zone 303 as determined by the second zone tester 302 while remaining out of the first zone 301 as determined by the first zone tester 300. The determination satisfies condition 321 and the state machine is placed in the non-operational state. This may indicate that the user has relinquished control of the weapon.

The weapon 305 is contemplated as moving back into the second zone 303 as determined by the second zone tester 302 while remaining out of the first zone 301 as determined by the first zone tester 300. There is no change in the state of the state machine when this happens. The state machine remains in the non-operational state. This may indicate that an unauthorized user has attempted to put the weapon back into an operational state. The logic of this embodiment does not allow this transition in the state of the state machine.

The logic of various described embodiments, which may be implemented mechanically or electronically or in other ways, is shown in the table below. The states listed in the table are implemented in the state machine 307, the actuator 209 or the position of the distal tip 80 of the stopper leg 74. The first tester may be the presence of the operating element 55 or 155 or the determination of the first zone tester 300. The second tester may be the depression of the grip safety 60, the signal receiver 200, or the determination of the second zone tester 302.

| First Tester (storage) | Second Tester (user) | Prior State | New State |
|---|---|---|---|
| Not in zone | Not in zone | Not Operational | Not Operational |
| Not in zone | Not in zone | Operational | Not Operational |
| Not in zone | In Zone | Not Operational | Not Operational |
| Not in zone | In Zone | Operational | Operational |
| In Zone | Not in zone | Not Operational | Not Determined |
| In Zone | Not in zone | Operational | Not Determined |
| In Zone | In Zone | Not Operational | Operational |
| In Zone | In Zone | Operational | Operational |

The entries in the table which indicate they are not determined may be either discharge or no discharge in particular embodiments.

I claim:

1. A system comprising:

a first zone tester with a first zone;

a second zone tester with a second zone;

a device implementing a state machine with an operational state and a non-operational state wherein the device is configured such that:

(a) when the state machine is in the operational state and the first zone tester determines that the weapon is not within the first zone and the second zone tester determines that the weapon is not within the second zone then the state machine enters the non-operational state, (b) when the state machine is in the operational state and the first zone tester determines that the weapon is not within the first zone and the second zone tester determines that the weapon is within the second zone then the state machine remains in the operational state, (c) when the state machine is in the operational state and the first zone tester determines that the weapon is within the first zone and the second zone tester determines that the weapon is not within the second zone then the state machine remains in the operational state, (d) when the state machine is in the non-operational state and the first zone tester determines that the weapon is not within the first zone and the second zone tester determines that the weapon is not within the second zone then the state machine remains in the non-operational state, (e) when the state machine is in the non-operational state and the first zone tester determines that the weapon is not within the first zone and the second zone tester determines that the weapon is within the second zone then the state machine remains in the non-operational state, and (f) when the state machine is in the non-operational state and the first zone tester determines that the weapon is within the first zone and the second zone tester determines that the weapon is within the second zone then the state machine enters the operational state; and a weapon with one or more functions wherein a function of the weapon is not operational when the device implementing the state machine is in the non-operational state.

2. The system of claim 1; wherein the device implements the state machine mechanically.

3. The system of claim 1; wherein the device implements the state machine electronically.

4. The system of claim 1; wherein the device comprises a computer implementing the state machine with a stored program.

5. The system of claim 1; wherein the weapon is a firearm and the function is discharge of the firearm.

6. The system of claim 5; wherein the first zone tester determines if the firearm is in a holster, and the second zone tester determines if a user is gripping the weapon.

7. A method of controlling a function of a weapon: comprising determining the status of the weapon with a first zone tester with a first zone;

determining the status of the weapon a second zone tester with a second zone;

providing the determinations to a device implementing a state machine with an operational state and a non-operational state wherein the device is configured such that:

(a) when the state machine is in the operational state and the first zone tester determines that the weapon is not within the first zone and the second zone tester determines that the weapon is not within the second zone then the state machine enters the non-operational state, (b) when the state machine is in the operational state and the first zone tester determines that the weapon is not within the first zone and the second zone tester determines that the weapon is within the second zone then the state machine remains in the operational state, (c) when the state machine is in the operational state and the first zone tester determines that the weapon is within the first zone and the second zone tester determines that the weapon is not within the second zone then the state machine remains in the operational state, (d) when the state machine is in the non-operational state and the first zone tester determines that the weapon is not within the first zone and the second zone tester determines that the weapon is not within the second zone then the state machine remains in the non-operational state, (e) when the state machine is in the non-operational state and the first zone tester determines that the weapon is not within the first zone and the second zone tester determines that the weapon is within the second zone then the state machine remains in the non-operational state, and (f) when the state machine is in the non-operational state and the first zone tester determines that the weapon is within the first zone and the second zone tester determines that the weapon is within the second zone then the state machine enters the operational state; and disabling a function of a weapon with at least one function when the state machine is in the non-operational state; and enabling the function when the state machine is in the operational state.

8. The method of claim 7; wherein the device implements the state machine mechanically.

9. The method of claim 7; wherein the device implements the state machine electronically.

10. The method of claim 7; wherein the device comprises a computer implementing the state machine with a stored program.

11. The method of claim 7; wherein the weapon is a firearm and the function is discharge of the firearm.

12. The method of claim 11; wherein the first zone tester determines if the firearm is in a holster, and the second zone tester determines if a user is gripping the weapon.

* * * * *